US006582345B2

(12) United States Patent
Roy

(10) Patent No.: US 6,582,345 B2
(45) Date of Patent: Jun. 24, 2003

(54) WEIGHT HOLDER DEVICE FOR WEIGHT LIFTING APPARATUS

(76) Inventor: Normand Roy, 610, de Cloridan, app. 6, Terrebonne, QBC (CA), J6X 3B2

( * ) Notice: Subject to any disclaimer, the term of this patent is extended or adjusted under 35 U.S.C. 154(b) by 88 days.

(21) Appl. No.: 09/879,941

(22) Filed: Jun. 14, 2001

(65) Prior Publication Data

US 2002/0016238 A1 Feb. 7, 2002

Related U.S. Application Data

(63) Continuation-in-part of application No. 09/497,100, filed on Feb. 3, 2000, now abandoned.

(51) Int. Cl.[7] ..... A63B 21/062
(52) U.S. Cl. ..... 482/98
(58) Field of Search ..... 482/92–94, 98–103, 482/106–109; D21/662, 680, 694

(56) References Cited

U.S. PATENT DOCUMENTS

| | | | | | |
|---|---|---|---|---|---|
| 90,304 | A | * | 5/1869 | Reilly | 482/94 |
| 4,411,424 | A | * | 10/1983 | Barnett | 482/99 |
| 4,546,971 | A | * | 10/1985 | Raasoch | 482/100 |
| 4,610,449 | A | * | 9/1986 | Diercks, Jr. | 482/98 |
| 4,712,793 | A | | 12/1987 | Harwick et al. | |
| 4,787,628 | A | | 11/1988 | Harwick et al. | |
| 4,971,305 | A | * | 11/1990 | Rennex | 482/93 |
| 4,974,838 | A | | 12/1990 | Sollenberger | |
| 5,000,446 | A | * | 3/1991 | Sarno | 482/101 |
| 5,135,453 | A | | 8/1992 | Sollenberger | |
| 5,348,522 | A | * | 9/1994 | Brotman | 482/98 |
| 5,350,344 | A | * | 9/1994 | Kissel | 482/98 |
| 5,669,861 | A | * | 9/1997 | Toups | 482/98 |
| 5,776,040 | A | * | 7/1998 | Webb et al. | 482/98 |
| 6,174,265 | B1 | * | 1/2001 | Alessandri | 482/5 |
| D456,865 | S | * | 5/2002 | Caporali et al. | D21/694 |
| 6,468,189 | B2 | * | 10/2002 | Alessandri | 482/99 |

FOREIGN PATENT DOCUMENTS

| | | | | | |
|---|---|---|---|---|---|
| CA | 1171109 | | * | 7/1984 | 482/99 |
| DE | 278064 | A1 | * | 4/1990 | 482/98 |
| EP | 177643 | A1 | * | 4/1986 | |
| FR | 2613237 | | * | 10/1988 | 482/98 |
| SU | 1720665 | A1 | * | 3/1992 | 482/102 |
| SU | 1766429 | A1 | * | 10/1992 | 482/98 |

* cited by examiner

*Primary Examiner*—Jerome W. Donnelly
*Assistant Examiner*—Victor K. Hwang

(57) ABSTRACT

A weight holder device for use in combination with a weight lifting exercise apparatus that includes a stack of several plates of equal size and weight and each having a vertical central through hole to receive a vertical lifting rod with a horizontal through bore and a horizontal hole extending from the central hole to a side of the plate. The device includes a shear pin removably inserted through both the horizontal hole and the through bore and supporting a variable number of upper plates of the stack. A protruding end of the pin has an axially adjustable holder mounted thereon for releasably and tightly suspending a fractional weight therefrom, between two spaced flanges secured to and radially extending from the pin. At least one of the flanges has a locking member and is axially adjustable relative to the other flange and along the pin to releasably engage and tightly retain the weight between them via the locking member in unlocking and locking configuration respectively.

20 Claims, 3 Drawing Sheets

WEIGHT HOLDER DEVICE FOR WEIGHT LIFTING APPARATUS

CROSS-REFERENCE TO RELATED APPLICATION

This application is a Continuation-In-Part (C.I.P.) of patent application Ser. No. 09/497,100, filed on Feb. 3, 2000, now abandoned.

FIELD OF THE INVENTION

The present invention relates to a weight holder device, and more specifically to a weight holder device adapted to support fractional weights for weight lifting apparatus with weight stacks.

BACKGROUND OF THE INVENTION

It is known that using variable weight lifting exercise apparatus or the like, allows the user to lift a certain quantity of weight plates selected by the insertion position of a shear pin along the plate stack, each plate weighting the same amount that is sometimes considered as being significant. Unfortunately, for certain type of exercise, the user may be required to slowly increase the total lifted weight from time to time in order not to overcharge his/her muscles thereby inducing pain. This would not be possible with the standard weight of the plates being as heavy as 5 kilograms (or 10 pounds) each.

Therefore, it becomes apparent that there is a need for a user to be able to lift a fractional weight of a standard plate such as 1 or 2 kg (2 or 4 lbs). Harwick et al show in their two U.S. Pat. Nos. 4,712,793 and 4,787,628 granted on Dec. 15, 1987 and Nov. 29, 1988 respectively, two different devices installed on top of the upper plate of the stack. These devices are quite complex for the simple purpose they serve; they are found as kits that include a fractional weight support unit with its multiple small weights that are not that easy to install, and are also quite expensive. Also, the devices may not be suitable for all variable weight lifting exercise apparatus since the latter can be found with different stack plate attachment feature as well as with different plate sizes. Furthermore, the user needs to take care of properly locating the fractional weights in order to ensure an adequate balancing of the overall stack to be lifted, fractional weights that need to be kept in a safe place to ensure that none of them get lost during the constant day-to-day usage of the apparatus.

OBJECTS OF THE INVENTION

It is therefore a general object of the present invention to provide a weight holder device for weight lifting apparatus that obviates the above noted disadvantages.

Another object of the present invention is to provide a weight holder device for weight lifting apparatus that can easily be installed.

A further object of the present invention is to provide a weight holder device for weight lifting apparatus that can easily be removed for convenience of the consumer on per need basic and reinstalled at any other location.

A further object of the present invention is to provide a weight holder device for weight lifting apparatus that is adapted for use with any of the existing variable weights of standard weight lifting apparatus found in any fitness center.

Still another object of the present invention is to provide a weight holder device for weight lifting apparatus that is manufactured at a minimum cost.

Still a further object of the present invention is to provide a weight holder device for weight lifting apparatus that can clamp additional weight(s) between the two flanges, at least one of which is axially adjustable along the pin.

Yet another object of the present invention is to provide a weight holder device for weight lifting apparatus that can secure and lock in place additional weight(s) on the pin between the two flanges.

Other objects and advantages of the present invention will become apparent from a careful reading of the detailed description provided herein, with appropriate reference to the accompanying drawings.

SUMMARY OF THE INVENTION

According to the present invention, there is provided a weight holder device for use in combination with a weight lifting exercise apparatus that includes an upright stationary frame, a weight stack in said frame formed of one or several plates of equal size and weight, each plate having a vertical central through hole and a horizontal hole extending from said central hole to a side of said plate, a vertical plate lifting rod extending through said central holes of said plates and adapted to be displaced in an up-and-down movement by a user, said plate lifting rod having a horizontal through bore, said weight holder device comprising a shear pin removably inserted through both said horizontal hole and said through bore and supporting a variable number of upper plates of said stack, at least one end of said pin protruding from said side of the supported plates, an axially adjustable holder mounted on said at least one end of said pin for releasably and tightly suspending at least one weight member therefrom, said at least one weight member weighing a fraction of the weight of each of said stacked plates.

Preferably, the adjustable holder includes a first and a second spaced flanges secured to and radially extending from said at least one end of said pin, said second flange having a locking member and being axially adjustable relative to said first flange along said pin for releasably engaging and tightly retained said at least one weight member therebetween via said locking member in unlocking and locking configuration respectively.

Preferably, the first flange is integral to the pin and inwardly located relative to said second flange, in proximity to the stacked plates.

Preferably, the first flange adjustably abuts against said side of at least the lowermost upper plate of the stack.

Preferably, the second flange is a disc coaxial with said pin and said at least one weight member is a ring member with a central circular hole of at least a diameter of said pin and less than a diameter of said disc, said ring member having a flange engaging central portion clamped and locked between said disc and said first flange in said locking configuration.

Alternatively, the second flange is a disc coaxial with said pin and said at least one weight member is a ring member with a central circular hole of at least a diameter of said disc, said ring member having a flange engaging central portion clamped between said disc and said first flange in said locking configuration.

Preferably, the second flange has a central cylindrical element coaxial with said pin and axially slidably receiving said disc thereon, said locking member having biasing element to axially bias said disc toward said first flange for clamping said flange engaging central portion of said ring member between said disc and said first flange in said locking configuration.

Preferably, the biasing element is a helical spring coaxially mounted around said pin.

Alternatively, the first flange is integral to the pin and outwardly located relative to said second flange, away from the stacked plates.

Alternatively, the adjustable holder includes a first and a second spaced flanges secured to and radially extending from said at least one end of said pin, said first and second flanges having a first and a second locking member respectively and being axially adjustable relative to and along said pin for releasably engaging and tightly retained said at least one weight member therebetween via said first and second locking members in unlocking and locking configuration respectively.

Preferably, the plate lifting rod has several horizontal through bores along its length, said through bores being in a number equal to the number of plates and equally spaced from each other by the distance equal to the thickness of said plates, whereby each one of said through bore is coaxially aligned with said horizontal hole of its respective plate.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings preferred embodiments of the present invention will be herein described for indicative purposes and by no means as of limitation.

Figure 1:
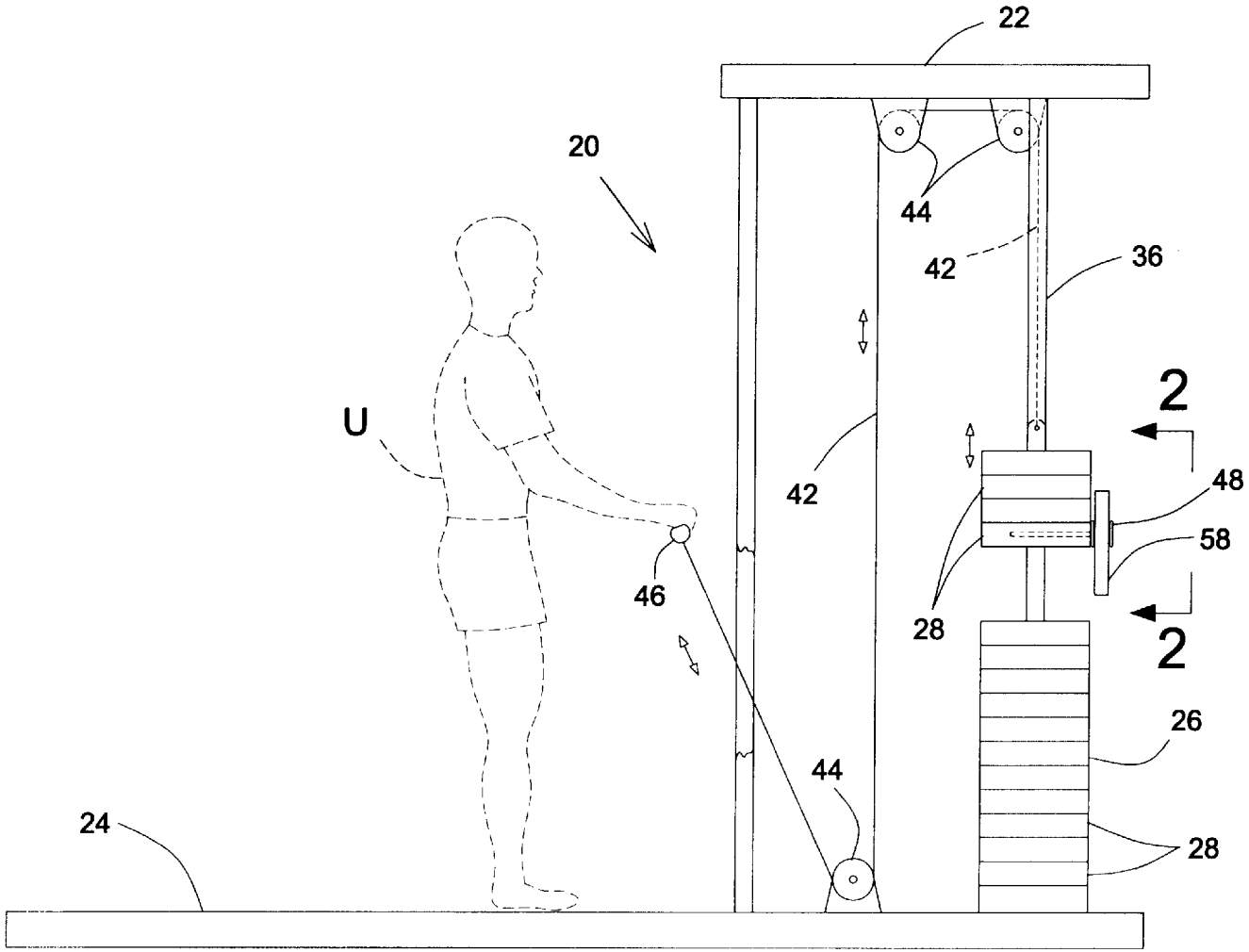
FIG. 1 is a perspective view of a first embodiment of a weight holder device according to the present invention installed on a variable weight lifting exercise apparatus.
Figure 3:
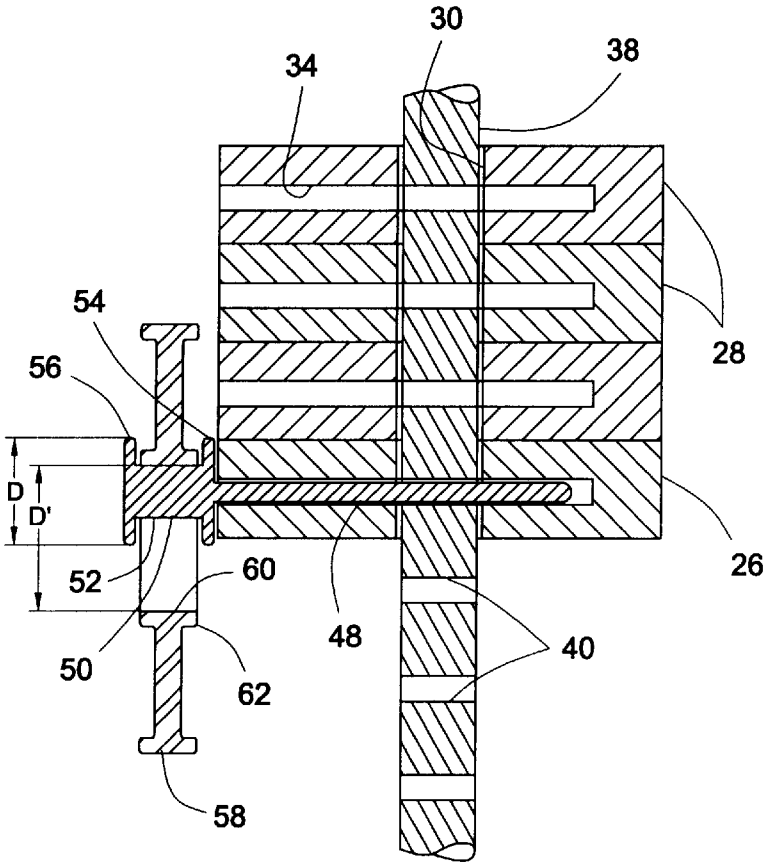
FIG. 3 is a section view taken along line 3—3 of FIG. 2.
Figure 2:
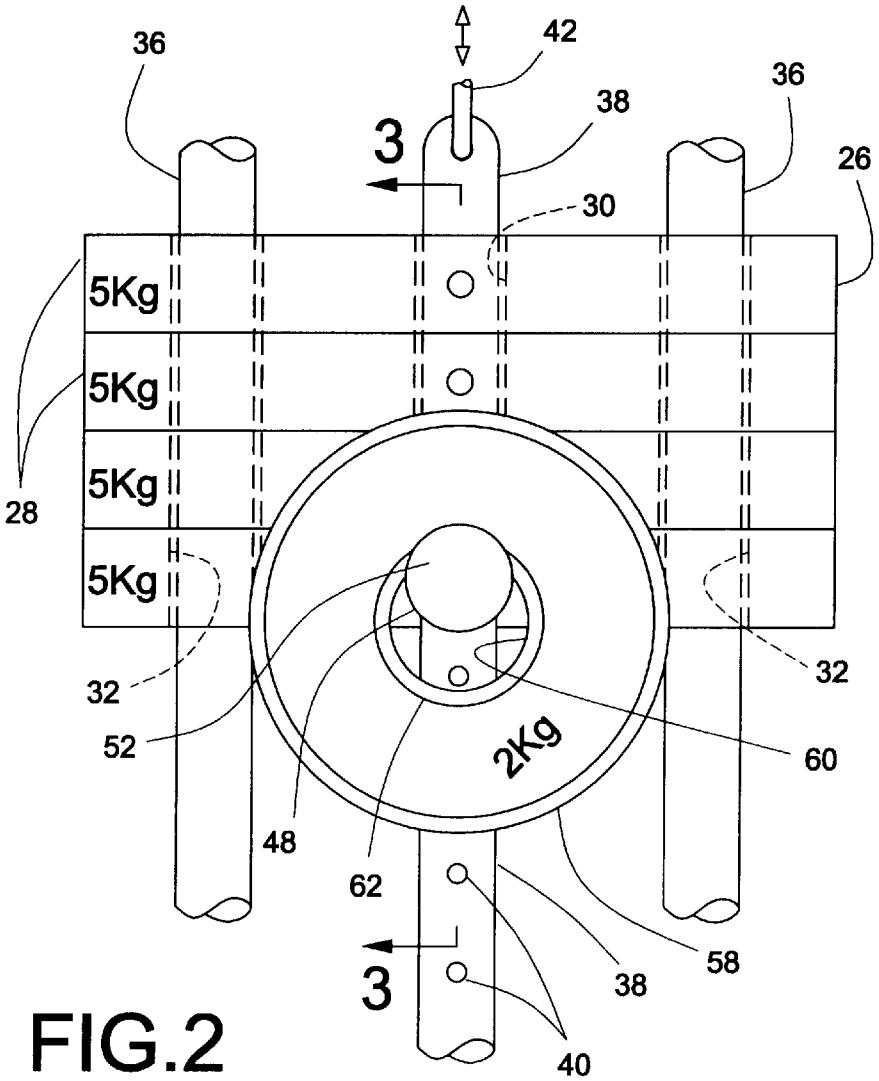
FIG. 2 is an enlarged partial side view taken along line 2—2 of FIG. 1.

Referring to FIGS. 1 to 3, there is shown a typical variable weight lifting exercise apparatus 20 that includes at least one upright frame 22 mounted on a base 24 that supports a generally vertical stack 26 formed of one or several weight plates 28, four (4) in this case. All plates 28 are essentially of equal weight and size.

Each weight plate 28 has a vertical central through hole 30, two vertical lateral through holes 32 located on each side of the central hole 30 along the length of the plate 28 and a horizontal hole 34 extending from the central hole 30 to at least one of the two long sides of the plate 28.

The upright frame 22 also includes two lateral guide rods 36 fixed thereto and extending through the lateral holes 32 of the plates 28 for guiding the latter in an up-and-down movement. A vertical plate lifting rod 38 extends through the central holes 30 of the plates 28. The plate lifting rod 38 has a plurality of horizontal through bores 40 in a number equal to the number of weight plates 28 in the stack 26, and each bore 40 is equally spaced from its next adjacent bore 40 by a distance equal to the thickness of the weight plates 28. With all plates 28 aligned in the stack 26, the horizontal bores 40 are each coaxially aligned with their respective horizontal hole 34. The plate lifting rod 38 is adapted to be displaced in an up-and-down movement by a user U operated system. The latter is essentially composed of a cable 42 attached to the top of the plate lifting rod 38 and running through different pulleys 44 to be terminated by a user handle 46.

During his period of exercise, the user U pulls on the handle 46 that in turn pulls on the plate lifting rod 38 via the cable 42 on the pulleys 44. In its up-and-down movement, the plate lifting rod 38, supports a variable quantity of upper weight plates 28 that are temporarily secured thereto via a shear pin 48 that is inserted into both the horizontal hole of the lowest plate 28 of the variable quantity of upper plates 28 and its corresponding through bore 40 of the vertical rod 38.

As shown in FIGS. 2 and 3, at least one end 50 of the shear pin 48 of the present invention protrudes out from the side of the supported plates 28 and includes a weight holder 52 formed thereon. The weight holder 52 preferably includes a pair of an inner 54 and an outer 56 spaced flanges generally radially extending therefrom; the latter preferably being discs with the inner one 54 abutting against the side of at least the lowermost of the upper plates 28. The weight holder 52 is adapted to releasably support a fractional weight 58 that is suspended therefrom, the latter preferably weighs a fraction of the weight of each of the plates 28. The fractional weight 58 is preferably a standard ring (or disc) used on typical weight lifting bars thus already available in any fitness center and essentially having a sliding fit inbetween the two discs 54, 56. The outer disc 56 is of an outer diameter D adapted to be of at most the inner diameter D' of the central circular hole 60 of the typical ring 58, used as fractional weight, in order to be engaged by the latter 58. Preferably, the spacing between the two discs 54, 56 is essentially sized to provide a slidable engagement with the typical inner flange 62 thickness of small fractional weights 58.

The preferred axial symmetry of the shape of the shear pin 48, including the weight holder 52, enables the user U to insert it into both the horizontal hole 34 of the lowermost of the upper plates 28 and its corresponding through bore 40 of the plate lifting rod 38 without having to worry about its orientation.

Figure 5:
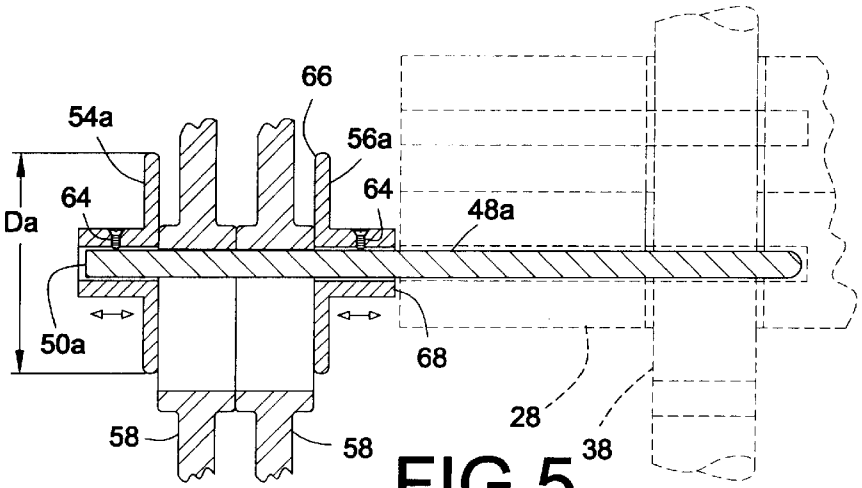
FIGS. 4 and 5 are section views of a second embodiment of a weight holder device according to the present invention with axially adjustable flanges, showing different locking configurations of the flanges with fractional weights locked between the same.
Figure 4:
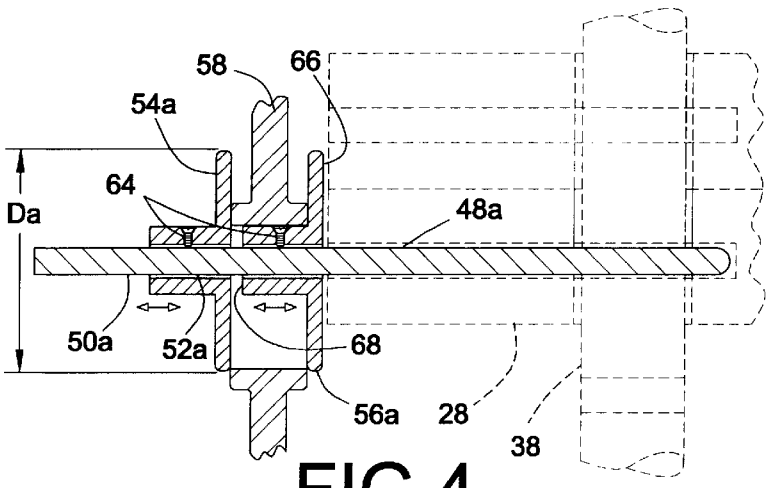

Referring to FIGS. 4 to 5, there is shown a second embodiment 48*a* of a weight holder device according to the present invention in which the two flanges 54*a*, 56*a* of the weight holder 52*a* are axially adjustable relative to the pin 48*a*. Each flange, preferably in the shape of inner 54*a* and outer 56*a* disc respectively, includes a locking member 64, preferably a radially oriented screw, to lock the respective disc 54*a*, 56*a* relative to the pin 48*a* when in place along the same. These adjustable discs 54*a*, 56*a* are used to clamp, squeeze or sandwich any number of fractional weights 58 between them.

When only one weight 58 is used, the inner disc 56*a* is preferably oriented in such a way to have its large diameter side 66 abutting the plates 28 (shown in dashed lines) and its small diameter side 68 receiving the weight sitting thereon, as shown in FIG. 4. In the case more than one weight 58 are clamped between the two discs 54*a*, 56*a*, the inner disc 56*a* is preferably oriented in the opposite direction in such a way to have all weights 58 sitting directly on the protruding end 50*a* of the pin 48*a*, as shown in FIG. 5. Obviously, either flange 54*a*, 56*a* could be thick enough to house its respective locking screw 64 so as to have a uniform disc shape with two parallel flat surfaces.

Additionally, the discs 54*a*, 56*a*, at least the outer one 54*a*, have an outer diameter Da slightly larger than the inner diameter D' of the hole 60 of the ring 58 in order to avoid any accidental falling off of the ring 58 when the pin 48*a* is inserted through the hole 34 of one of the plates 28. Then, at least one of the discs 54*a*, 56*a* needs to be unlocked and removed from pin 48*a* prior to the removal of the ring(s) 58.

For quick weight 58 changing turnaround time, any equivalent quick release device (not shown) easily operable by the user U can obviously replace the screw 64 of the outer disc 54*a*.

Figure 6:
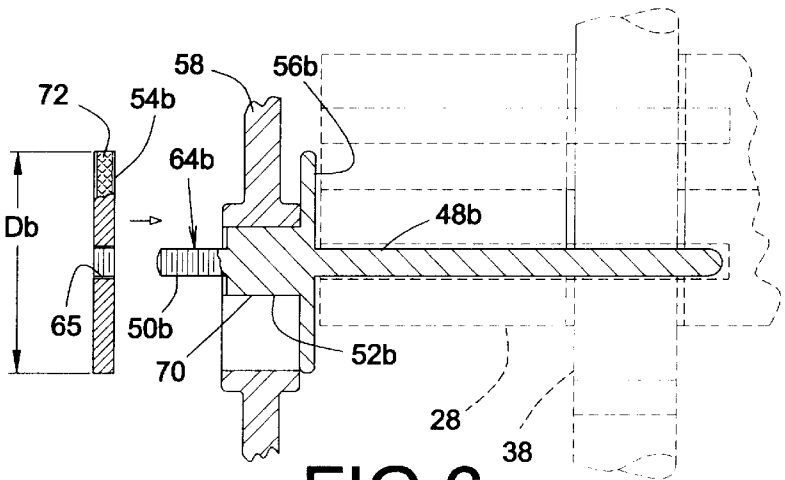
FIG. 6 is an exploded section view of a third embodiment of a weight holder device according to the present invention, showing the outer flange engaging an axial thread of the exposed extremity of the pin.

Referring to FIG. 6, there is shown a third embodiment 48*b* of a weight holder device according to the present invention in which only the outer flange 54*b* of the weight holder 52*b* is axially adjustable relative to the pin 48*b* and the inner flange 56*b* integral to the same 48*b*. The locking member 64*b* is preferably a central axial threaded through hole 65 of the outer disc 54*b* adapted to engage the threaded extremity 50*b* of the pin 48*b*. The portion of the holder 52*b* integral to the pin 48*b* preferably includes cylindrical section 70 of a diameter slightly larger than the threaded extremity 50*b* such that a weight 58 sitting thereon does not get in touch with and damage the threaded extremity 50*b*.

To ensure a good clamping of the weight 58 between the inner and outer discs 54*b*, 56*b*, the length of that cylindrical section 70 is slightly shorter than the typical thickness 62 of the weight 58. A grip like surface finish or coating 72 of the external circumferential periphery of the outer disc 54*b* is preferred for a good tightening of the latter on the pin 48*b*. Obviously, the disc 54*b* also has an outer diameter Db slightly larger than the inner diameter D' of the hole 60 of the ring 58 in order to avoid any accidental falling off of the ring 58 when the pin 48*b* is inserted through the hole 34 of one of the plates 28.

Figure 7:
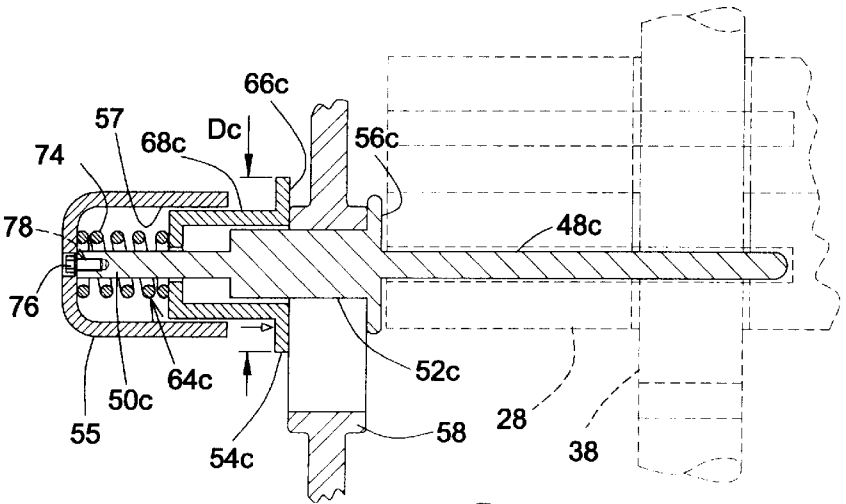
FIG. 7 is a section view similar to FIG. 4 of a fourth embodiment of a weight holder device according to the present invention, showing the outer flange secured to the extremity of the pin and having a disc spring biased against a fractional weight engaging thereon.

Referring to FIG. 7, there is shown a fourth embodiment 48*c* of a weight holder device according to the present invention in which only the outer flange 54*c* of the weight holder 52*c* is axially slidably adjustable relative to the pin 48*c* and biased toward the inner flange 56*c* integral to the same 48*c*. The locking member 64*c* includes a biasing member 74, preferably a helical type spring, that axially pushes against the disc 54*c* which in turn abuts against a weight 58 releasably clamped between the two discs 54*c*, 56*c*. A cover part 55 is releasably secured to the extremity 50*c* of the pin 48*c*, preferably via an axial screw 76 engaging a corresponding threaded hole 78 of the pin 48*c*, and has an internal cavity 57 that preferably fully houses the spring 74 therein.

As shown in FIG. 7, the outer disc 54*c* has its large diameter side 66*c* adapted to abut the weight 58 when biased and its small diameter side 68*c* adapted to freely axially engage the cavity 57 when retracted in by the user U to release the weight 58. Obviously, since the intent is to release the weight 58 without removing the outer disc 54*c*, the latter preferably has an outer diameter Dc at least slightly smaller the diameter D' of the hole 60. Alternatively, the outer disc 54*c* could have a diameter larger than the hole 60 as long as the outer diameter of the inner disc 56*c* is smaller than the hole 60 to allow for retrieval of the weight once the pin 48*c* is removed from the plate 28.

As an ordinary person skilled in the art would realize, the shear pins 48, 48*a*, 48*b* and 48*c* are preferably made out of any highly resistant material with corrosion protection finish on surfaces, such as stainless steel or the like.

Although the present weight holder device has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A fractional-weight holding, weight stack selector shear pin for supporting at least one supplementary, fractional weight member having an aperture and for selecting an effective number of weight plates in a weight stack by inserting the fractional-weight holding, weight stack selector shear pin into operative engagement with a bottom weight plate of the selected weight plates and into operative engagement with a weight plate lifting rod to support the bottom weight and those selected weight plates above the bottom weight plate to the weight plate lifting rod, said fractional-weight holding, weight stack selector shear pin comprising:

a shear pin having an axial length, a first end of said shear pin for engagement with the plate lifting rod, and a second end of said shear pin coaxial with said first end and for selectively supporting the at least one supplementary, fractional weight member;

a first flange and a second flange located at said second end of said shear pin; and said second flange axially spaced from said first flange and selectively, axially movable along said second end of said shear pin, wherein the at least one supplementary, fractional weight member may be securely clamped between said first and second flanges and prevented from axial movement along said second end of said shear pin.

2. The fractional-weight holding, weight stack selector shear pin of claim 1, wherein said first flange is an inner flange for abutted engagement with a side of the bottom weight plate.

3. The fractional-weight holding, weight stack selector shear pin of claim 2, wherein said inner flange is axially movable along said shear pin.

4. The fractional-weight holding, weight stack selector shear pin of claim 3, wherein said inner flange further includes a locking member to selectively fix said inner flange to said shear pin.

5. The fractional-weight holding, weight stack selector shear pin of claim 2, wherein said inner flange is integral with said shear pin.

6. The fractional-weight holding, weight stack selector shear pin of claim 2, wherein said inner flange has a diameter greater than a diameter of the central aperture of the at least one supplementary, fractional weight member to be supported by said second end of said shear pin.

7. The fractional-weight holding, weight stack selector shear pin of claim 2, wherein said inner flange has a diameter less than or equal to a diameter of the central aperture of the at least one supplementary, fractional weight member to be supported by said second end of said shear pin.

8. The fractional-weight holding, weight stack selector shear pin of claim 1, wherein said second flange includes a locking member to selectively fix said second flange to said shear pin.

9. The fractional-weight holding, weight stack selector shear pin of claim 8, wherein said locking member comprises a threaded fastener.

10. The fractional-weight holding, weight stack selector shear pin of claim 1, wherein said second flange comprises a disk with a central hole having internal threads and said second end of said shear pin has external threads for operative engagement with said internal threads of said second flange.

11. The fractional-weight holding, weight stack selector shear pin of claim 10, wherein said second flange includes a peripheral portion with a gripping surface.

12. The fractional-weight holding, weight stack selector shear pin of claim 1, wherein said second flange is operatively engaged with a biasing element to bias said second flange toward said first flange and into engagement with the at least one supplementary, fractional weight member.

13. The fractional-weight holding, weight stack selector shear pin of claim 12, wherein said biasing element comprises a helical spring.

14. The fractional-weight holding, weight stack selector shear pin of claim 12, wherein said second flange further comprises a cover that houses said biasing element.

15. The fractional-weight holding, weight stack selector shear pin of claim 14, wherein said cover is secured to said second end of said shear pin by a releasable fastener.

16. The fractional-weight holding, weight stack selector shear pin of claim 1, wherein said second flange has a diameter greater than a diameter of the central aperture of the at least one supplementary, fractional weight member to be supported by said second end of said shear pin.

17. The fractional-weight holding, weight stack selector shear pin of claim 1, wherein said second flange has a diameter less than a diameter of the central aperture of the at least one supplementary, fractional weight member to be supported by said second end of said shear pin.

18. The fractional-weight holding, weight stack selector shear pin of claim 1, wherein each weight plate of the weightstack to be engaged by the weight-holding weight stack shear pin has a horizontal hole and the plate lifting rod has a plurality of bores spaced by a distance equal to a thickness of each weight plate so that each horizontal hole is coaxially aligned with one of the plurality of bores in the plate lifting rod.

19. The fractional-weight holding, weight stack selector shear pin of claim 1, wherein said second end of said shear pin has a diameter greater than a diameter of said first end of said shear pin.

20. In a weight stack of a plurality of weight plates in which an effective number of weight plates in the weight stack are selected by inserting a shear pin into operative engagement with a bottom weight plate of the selected weight plates to support the bottom weight plate and those selected weight plates above the bottom weight plate to a plate lifting rod extending through the plurality of weight plates of the weight stack, the shear pin having a first end for engagement with the plate lifting rod and a second end coaxial with the first end for selectively supporting at least one supplementary weight member having a central aperture, wherein the improvement comprises, said second end of said shear pin includes a first flange and a second flange;

said second flange axially movable along said second end of said shear pin to securely clamp the at least one supplementary weight between said first and second flanges and prevent axial movement of the at least one supplementary weight member supported on said second end.

* * * * *